US006881015B2

(12) United States Patent
Wallstein et al.

(10) Patent No.: US 6,881,015 B2
(45) Date of Patent: Apr. 19, 2005

(54) WEDGE BARREL FOR A MINE ROOF CABLE BOLT

(75) Inventors: Alexander I. Wallstein, Salt Lake City, UT (US); Raymond Brandon, Grand Junction, CO (US); Roland Walker, Syracuse, UT (US); Steven Brady, Ogden, UT (US)

(73) Assignee: Dywidag-Systems International, U.S.A., Inc., Bolingbrook, IL (US)

( * ) Notice: Subject to any disclaimer, the term of this patent is extended or adjusted under 35 U.S.C. 154(b) by 0 days.

(21) Appl. No.: 10/676,057

(22) Filed: Oct. 1, 2003

(65) Prior Publication Data

US 2004/0135422 A1 Jul. 15, 2004

Related U.S. Application Data

(60) Provisional application No. 60/418,875, filed on Oct. 16, 2002.

(51) Int. Cl.[7] ..... E21D 20/00; F16B 39/36

(52) U.S. Cl. ..... 405/259.1; 411/410; 411/267

(58) Field of Search ..... 405/259.1; 411/533, 411/403, 410, 265, 267, 270, 433, 354

(56) References Cited

U.S. PATENT DOCUMENTS

| | | | | |
|---|---|---|---|---|
| 2,850,937 A | | 9/1958 | Ralston | |
| 3,650,112 A | | 3/1972 | Howlett et al. | |
| 4,140,428 A | | 2/1979 | McLain et al. | |
| 4,367,664 A | * | 1/1983 | Ekshtut | 81/436 |
| 4,384,812 A | * | 5/1983 | Miyagawa | 411/410 |
| 4,449,855 A | | 5/1984 | Langwadt | |
| 4,648,753 A | | 3/1987 | Stephan | |
| 4,724,639 A | | 2/1988 | Moser | |
| 4,798,501 A | | 1/1989 | Spies | |
| 4,832,534 A | | 5/1989 | Duvieusart | |
| 4,884,377 A | | 12/1989 | Matt | |
| 5,219,253 A | * | 6/1993 | Shinjo | 411/403 |
| 5,230,589 A | | 7/1993 | Gillespie | |
| 5,259,703 A | | 11/1993 | Gillespie | |
| 5,797,659 A | * | 8/1998 | Fuller | 301/35.623 |
| 5,829,922 A | | 11/1998 | Calandra, Jr. et al. | |
| 5,919,006 A | | 7/1999 | Calandra, Jr. et al. | |
| 6,056,482 A | | 5/2000 | Calandra, Jr. et al. | |
| 6,322,290 B1 | | 11/2001 | Calandra, Jr. et al. | |
| 6,712,574 B1 | * | 3/2004 | Roopnarine | 411/433 |
| 2003/0068214 A1 | * | 4/2003 | Sommer et al. | 411/533 |

FOREIGN PATENT DOCUMENTS

| | | |
|---|---|---|
| AT | 198482 | 7/1958 |

* cited by examiner

*Primary Examiner*—Sunil Singh
(74) *Attorney, Agent, or Firm*—Marshall, Gerstein & Borun LLP

(57) ABSTRACT

A mine roof bolt for use with a cable comprises a barrel having a first end and a second end, the second end having a rounded surface, a bore extending through the barrel between the first end and the second end and including a tapered portion, the bore sized to receive the cable, a pair of wedges sized for placement in the tapered portion of the bore and adapted to frictionally engage a cable disposed in the tapered portion of the bore, a recess defined in the first end of the barrel, and a driving nut sized for insertion in the recess and adapted for engagement by a driving tool.

22 Claims, 4 Drawing Sheets

WEDGE BARREL FOR A MINE ROOF CABLE BOLT

RELATED APPLICATIONS

This application claims priority under 35 U.S.C. §119(e) from U.S. Provisional Application Ser. No. 60/418,875, filed Oct. 16, 2002.

FIELD OF THE INVENTION

The present invention relates generally to roof bolts used in underground mining operations and, more particularly, to a wedge barrel for a mine roof bolt having a recessed area sized to accept a spinning tool.

BACKGROUND OF THE INVENTION

In mining operations, bolts are often used to support the roof of the mine. Typically, a hole is drilled into the rock formation that forms the mine roof, and then a mine roof bolt is placed in the hole and secured by a fast-curing resin material or other suitable substance. The roof bolt, which can be formed of wire strands woven or wound together to form a cable, includes a widened bearing plate that bears against a portion of the ceiling, thus holding a portion of the ceiling in place.

One approach for installing such bolts is to drill an over-sized hole into the rock and then insert one or more resin cartridges into the hole. The elongated cable portion of the mine roof bolt is then forced into the hole, and rotated. This process ruptures the resin cartridges and mixes the two resin components together within the space between the cable portion of the bolt structure and the over-sized hole.

Such roof bolts typically include a wedge barrel. The wedge barrel provides a bearing surface so that the tensile load carried by the elongated cable bolt can be suitably transferred to the bearing plate. The wedge barrel is commonly joined to the cable bolt by a plurality of wedges which are wedged between the cable itself and an inside tapered surface of the wedge barrel prior to installation of the roof bolt. Using a suitable tool, the wedge barrel is spun to rotate the cable within the hole as outlined above.

DETAILED DESCRIPTION OF THE PREFERRED EMBODIMENT

The examples described herein are not intended to be exhaustive or to limit the scope of the invention to the precise form or forms disclosed. Rather, the following exemplary embodiments have been chosen and described in order to best explain the principles of the invention and to enable others skilled in the art to follow the teachings thereof.

Figures 1, 1A:
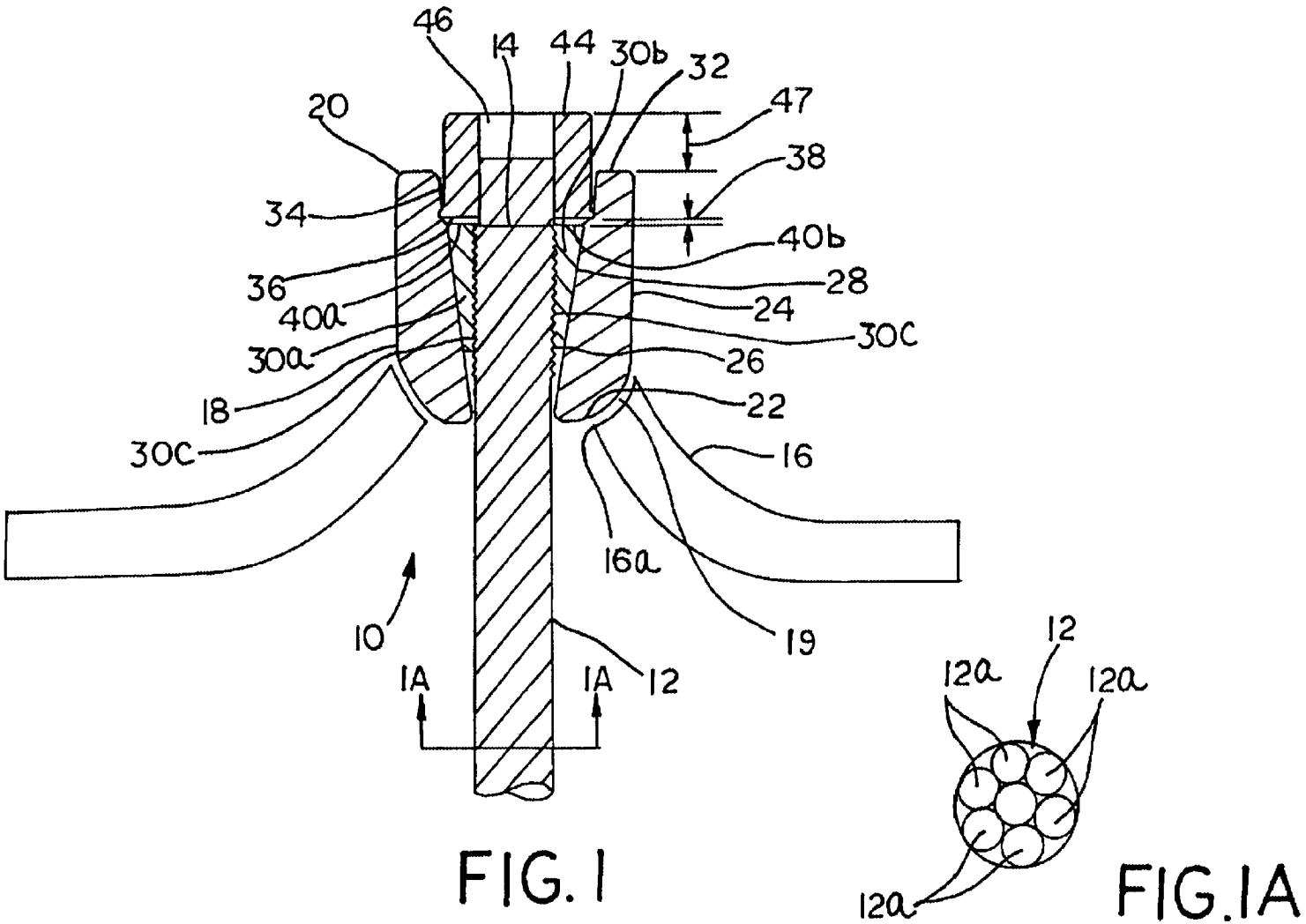
FIG. 1 is a fragmentary cross-sectional view of a mine roof bolt including a wedge barrel assembled in accordance with the teachings of a first disclosed example of the present invention.
FIG. 1A is cross-sectional view taken along line 1A—1A of FIG. 1.

Referring now to the drawings, a mine roof bolt assembled in accordance with the teachings of a first disclosed example of the present invention is shown therein and is generally referred to by the reference numeral 10. The mine roof bolt 10 includes a cable 12 (FIG. 1 only) which is typically formed of a plurality of woven or wound wires 12*a* (FIG. 1A) strands as is known to those of skill in the art. The positional terms that are used in the following description, such as "top" and "bottom", etc., relate to the roof bolt 10 positioned as shown in the drawings. It will be understood that, when the roof bolt 10 is in use, the roof bolt 10 will be inverted from the position shown in FIG. 1 such that the cable 12 extends upwardly into a bore hole drilled in the ceiling of a mine. The cable 12 includes a first end 14 (FIG. 1) and a second end (not shown but which is disposed within the roof of the mine as would be known). The second end is inserted into the bore hole (not shown) as would be known.

The roof bolt 10 also includes a bearing plate 16 (shown only partially in FIG. 1) having an aperture 16*a*, and a wedge barrel 18. The wedge barrel 18 includes a top portion 20, a bottom portion 22, an external surface 24, and an internal bore 26. The bottom portion 22 of the wedge barrel 18 meets the bearing plate 16 along a generally curved or spherical interface 19 as would be known and which, in a preferred form, serves to compensate for situations when the hole axis and the ceiling of the mine are not perpendicular. It will be understood that the bearing plate spreads out in a direction generally perpendicular relative to the axis of the cable 12 when viewing FIG. 1.

The internal bore 26 has a generally tapered, sloping, or generally conical internal surface 28, which is shaped to interact with or correspond to a pair of sloped or tapered wedges 30*a*, 30*b* in order to secure the first end 14 of the cable 12 to the wedge barrel 18. The tapered wedges 30*a*, 30*b* are typically sloped or tapered on their outside surfaces (the surfaces away from the centerline of the bore 26) and typically include threads 30*c* on their inside surfaces (the surfaces facing and abutting the cable 12). The internal surfaces, which are preferably hardened, are forced into engagement with the cable 12 in a known manner in order to bite and grip the cable when the wedges 30*a*, 30*b* are forced further into the tapered bore 26 (i.e., downward when viewing FIG. 1).

Figure 3:
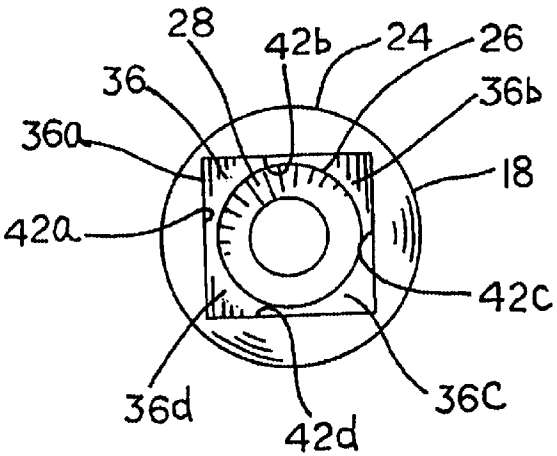
FIG. 3 is a top plan view thereof.
Figure 2:
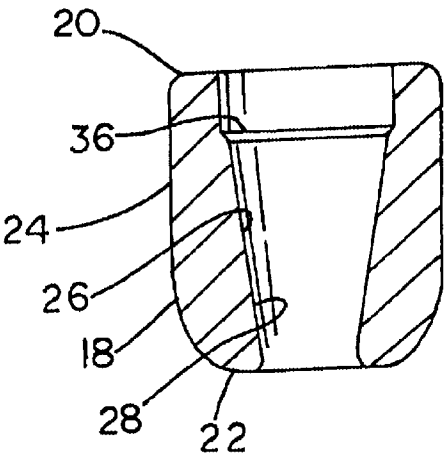
FIG. 2 is a fragmentary cross-sectional view of the wedge barrel.

The internal bore 26 includes an upper portion 32 which is shaped to form a recess 34. In the example of FIGS. 1–5, the recess is generally square. Other suitable shapes may be employed. The recess 34 includes a floor 36 (FIGS. 1–3) defined by, in the disclosed example, four sections 36*a*, 36*b*, 36*c*, and 36*d* (FIG. 3). Preferably, the floor 36 is spaced downward from the top portion 20 of the wedge barrel 18 so as to leave a gap 38 between the floor 36 and an upper end 40*a*, 40*b*, of the wedges 30*a*, 30*b*, respectively. The recess 34 includes four internal sidewalls 42*a*, 42*b*, 42*c* and 42*d* (FIG. 3).

Figure 4:
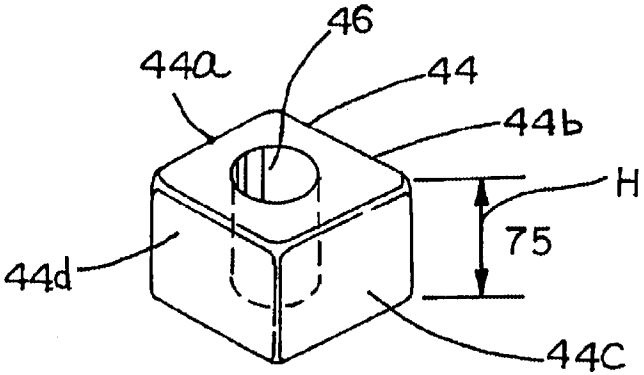
FIG. 4 is a perspective view of a square nut sized for insertion in the recess of the wedge barrel.

The roof bolt 10 may be provided with a nut 44 (FIGS. 1, 4 and 5) having a central bore 46 sized to accommodate a portion of the cable 12. According to the disclosed example, the nut 44 has a generally square shape when viewed in plan in order to complement the generally square shape of the recess 34. Again, other suitable shapes may be employed. It will be understood that, should the shape of the recess 34 be altered, then the shape of the nut 44 may also be altered in order to complement the shape of the recess 34 such that the nut 44 will suitably fit into the recess 34. The nut 44 includes four sidewalls 44*a*, 44*b*, 44*c*, and 44*d* (FIG. 4). In accordance with the disclosed example, the nut 44 is sized to measure approximately 1.125 inches by 1.125 inches when viewed in plan, which matches the size of many readily available driving tools/sockets. The recess 34 is thus suitably sized to receive the nut 44 of this relatively standard size. Also, according to the disclosed example, the height H of the nut 44 is preferably sized so that the nut 44 includes a protruding portion 47 when suitably placed in the recess 34. In the disclosed example, the protruding portion 47 measures about 0.5 inches.

Preferably, the wedge barrel 18 is formed of cast or forged steel. As is known, the wedges 30*a*, 30*b*, which are preferably formed of hardened steel, include teeth that bite into the cable 12. The outer surface 24 of the wedge barrel 18 is preferably round when viewed in plan (FIG. 3). Further, as alluded to above, the bottom 22 of the wedge barrel 18 is formed in a generally spherical dome shape where it interfaces with the bearing plate 16.

A mine roof bolt 10 assembled in accordance with the disclosed example may offer one or more functional advantages. For example, when the recess 34 and the nut 44 are sized as outlined above, only a standard 1⅛" square socket tool, which is readily available in underground mining operations, is required to spin the cable bolt 10 into the resin material. No extra tool is required to install the mine roof bolt 10. Also, the square pattern of the recess 34 is part of the wedge barrel casting, and thus the square recess cannot break off during spinning of the roof bolt 10. Moreover, due to the fact that the end 14 of the cable 12 is recessed within the wedge barrel 18 in or below the recess 34 and/or below the nut 44, the risk of injury may be reduced.

In use, a miner can easily make a tool by welding a square piece to a standard socket. The cost for such a tool may be insignificant, and the miner may make as many tools as required. The wedge barrel 18 also may be delivered with a square recess only, absent the nut 44.

Figure 5:
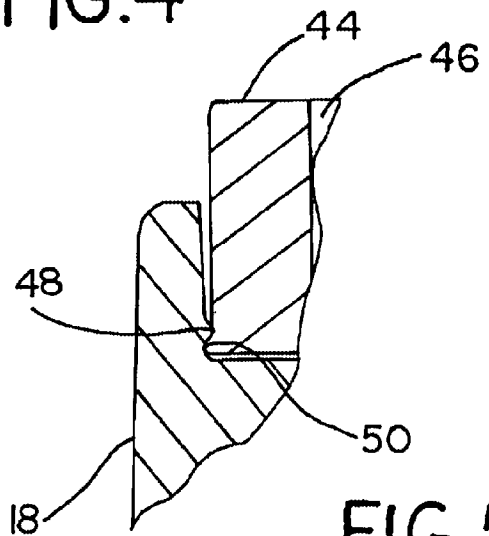
FIG. 5 is an enlarged fragmentary cross-sectional view of a wedge barrel assembled in accordance with the teachings of a second disclosed example of the present invention and including a snap-in-place square nut for insertion into the recess of the wedge barrel.

Alternatively, the miner may request that the roof bolt 10 be supplied with the nut 44 already in place within the recess 34 in accordance with a second disclosed example of the present invention. Referring to FIG. 5, the recess 34 may be provided with one or more barbs 48 which are sized to engage a corresponding protrusion or ledge 50 provided adjacent a lower portion of the nut 44. The nut 44 may be formed from a suitable molded plastic or from a steel or cast material. In such a case, the miner does not need to produce or fabricate any drive tool other than a standard and readily available socket.

The nut 44 is sized to be taller than the recess 34, such that a portion of the nut 44 (see for example, FIG. 5) extends out of the recess and beyond the top portion 20 of the wedge barrel 18. Thus, a sufficient portion is exposed to permit the nut to be engaged by a suitable driving tool, such as an impact wrench or other power drill/tool of the type known to those of skill in the art and commonly employed in mining operations.

Figure 6:
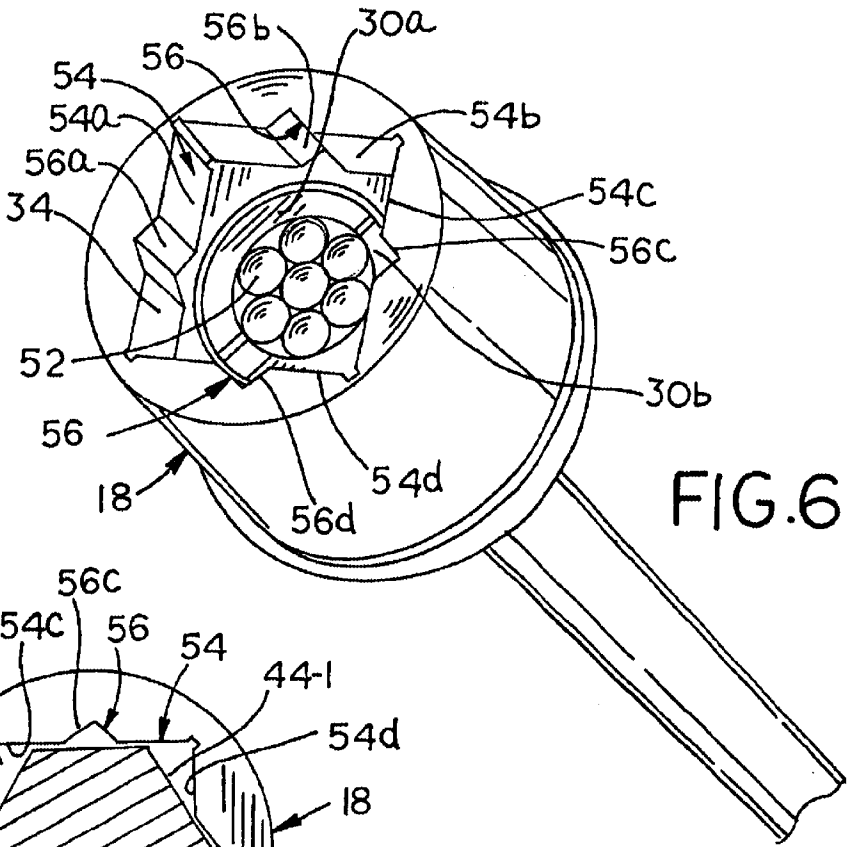
FIG. 6 is an enlarged fragmentary view in perspective of a wedge barrel the assembled in accordance with the teachings of another disclosed example of the present invention and illustrating the tail of the cable disposed below the recess.

Referring now to FIG. 6, it can be seen that an upper end 52 of the cable 12 may be sized so as to terminate before the upper end 52 of the cable 12 extends into the recess 34. Thus, in accordance with the disclosed example, there may be little or no contact between the nut 44 (for example, the nut 44 shown in FIGS. 1, 4 or 5, or the nut 44-1 of FIG. 8), and the upper and 52 of the cable 12.

Figure 7:
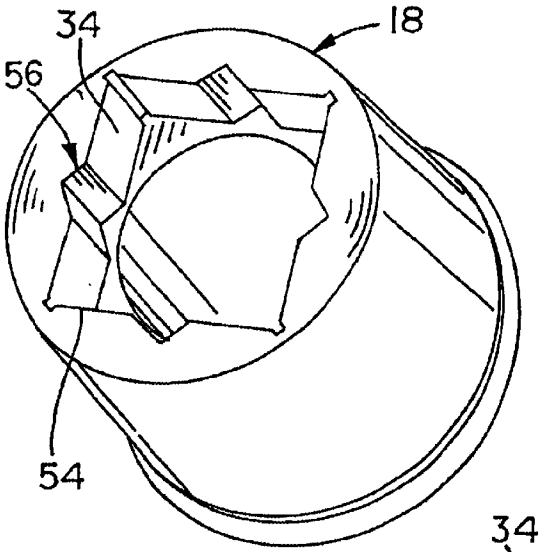
FIG. 7 is an enlarged fragmentary view in perspective of a recess sized to receive either a square driving nut or a hex-shaped driving nut.
Figure 8:
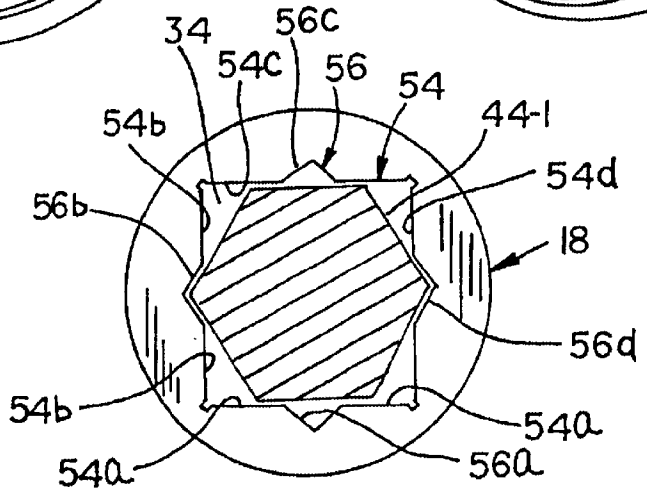
FIG. 8 is an enlarged fragmentary plan view illustrating the manner by which a hex-shaped driving nut is received in the recess.

Referring now to FIGS. 7 and 8, the recess 34 shown therein is slightly modified to include a first set of surfaces 54 and a second set of surfaces 56. More specifically, the surfaces 54*a*, 54*b*, 54*c*, and 54*d* are sized to receive a square driving nut the second set of surfaces 56, in the disclosed example, may take the form of pointed grooves 56*a*, 56*b*, 56*c* and 56*d* formed in each of the surfaces 54*a*, 54*b*, 54*c* and 54*d*, respectively. Thus, a square nut 44, such as the nut discussed above with respect to the earlier disclosed example(s), will engage the surfaces 54*a*–54*d* of the recess 34. Similarly, a hex-shaped nut 44-1 disposed in the recess 34 will engage, for example, two of the grooves 56*a*–56*d* and two of the surfaces 54*a*–54*d*. Accordingly, the recess 34 will receive either the square nut 44 or the hex-shaped nut 44-1.

In accordance with one or more of the examples disclosed herein, one or more advantages may be realized. For example, a miner (not shown) can easily make a suitable driving tool by welding a square piece to a standard socket (typically a 1⅛ inch socket). The cost for fabricating such a tool is insignificant, and thus the miner can make as many tools as required. Further, the wedge barrel may be delivered with a suitable nut (either a square or hexagonal nut) as outlined above. Further, it will be appreciated that the wedge barrel may be cast, and the nut may be formed of a suitable metal or from a suitable high impact plastic material.

Figure 9:
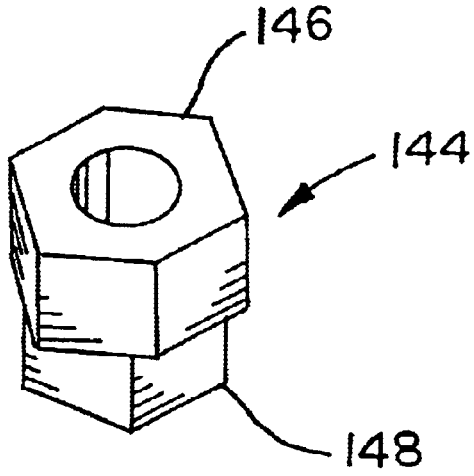
FIG. 9 is an enlarged perspective view of a driving nut having a square portion and a hexagonal portion.

Referring now to FIG. 9, a nut 144 is shown which may be adaptable for use with either of the embodiments discussed above. The nut 144 includes a hexagonal end 146 and a square end 148. It will be appreciated that the hexagonal end 146 of the nut 144 may be inserted into the hexagonal recess of FIGS. 6–8 and may be driven by a square driver (not shown) suitably engaging the square end 148. Similarly, the square end 148 of the nut 144 may be inserted into the square recess of FIGS. 1–5 and may be driven by a hexagonal driver (not shown) suitably engaging the hexagonal end 146.

It will be appreciated that details of the various embodiments discussed herein are not intended to be mutually exclusive. Thus, various aspects and details of the disclosed examples may be interchanged. Also, it will be appreciated that the recess 34 and the nut 44 may take a variety of complementary forms, such as oval-shaped, star-shaped, etc.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed:

1. A mine roof bolt for use with a cable, the mine roof bolt comprising:

a barrel, the barrel having a first end, a second end, and a generally cylindrical outer surface;

a bore extending through the barrel between the first end and the second end, the bore including a generally conical portion narrowing toward the second end, the bore sized to receive the cable;

a pair of wedges sized for placement in the conical portion of the bore, the wedges adapted to engage the cable with progressively greater force in response to movement of the wedges toward the second end; and a recess countersunk in the first end of the barrel, an internal portion of the recess including a plurality of faces arranged to non-rotationally receive a driving nut.

2. The roof bolt of claim 1, wherein the plurality of faces are shaped to receive a square driving nut.

3. The roof bolt of claim 1, wherein the plurality of faces are shaped to receive a hex-shaped driving nut.

4. The roof bolt of claim 1, wherein the recess includes a first set of the faces are adapted to engage a hex-shaped driving nut and a second set of the faces are adapted to engage a square driving nut.

5. The roof bolt of claim 1, wherein the recess includes a plurality of sidewalls, the sidewalls sized such that a driving nut placed in the recess extends beyond the first end of the barrel.

6. The roof bolt of claim 1, wherein the recess includes a plurality of sidewalls, at least some of the sidewalls having retaining barbs.

7. The roof bolt of claim 6, in combination with a driving nut, the nut including a plurality all of sidewalls, at least some of the sidewalls having a ledge sized to engage the retaining barbs.

8. The roof bolt of claim 1, wherein the second end of the barrel includes a rounded portion.

9. The roof bolt of claim 8, in combination with a bearing plate having an aperture, the aperture including a seat sized to receive the rounded portion of the second end of the barrel.

10. The roof bolt of claim 1, wherein the recess includes a floor, and wherein a gap is defined in the bore between the floor of the recess and conical portion of the bore.

11. The roof bolt of claim 1, wherein the wedges are sloped and include teeth adapted to grip the cable.

12. A mine roof bolt for use with a cable, the mine roof bolt comprising:

a barrel, the barrel having a first end and a second end, the second and having a rounded surface;

a bore extending through the barrel between the first end and the second end, the bore including a tapered portion, the bore sized to receive the cable;

a pair of wedges sized for placement in the tapered portion of the bore, the wedges shaped to engage the tapered portion of the bore, the wedges further adapted to cooperate with the tapered portion of the bore to frictionally engage a cable disposed in the tapered portion of the bore;

a recess defined in the first end of the barrel; and a driving nut sized for insertion in the recess and arranged to transfer rotation of the driving nut directly to the barrel, the driving nut adapted for engagement by a driving tool.

13. The roof bolt of claim 12, wherein the driving nut comprises at least one of a square driving nut and a hex-shaped driving nut.

14. The roof bolt of claim 13, wherein the recess includes a first set of internal faces adapted to engage the hex-shaped driving nut and a second set of internal faces adapted to engage the square driving nut.

15. The roof bolt of claim 12, wherein the recess includes a plurality of sidewalls, the sidewalls sized such that the driving nut disposed in the recess extends beyond the first end of the barrel.

16. The roof bolt of claim 12, wherein the recess includes a plurality of sidewalls, at least one of the sidewalls having a retaining barb.

17. The roof bolt of claim 16, wherein the driving nut includes a plurality of faces, at least one of the faces including a ledge sized to engage the retaining barb.

18. The roof bolt of claim 12, including a bearing plate having an aperture, the aperture including a seat sized to receive the rounded surface of the second end of the barrel.

19. The roof bolt of claim 12, wherein the recess includes a floor, and wherein a gap is defined in the bore between the floor of the recess and tapered portion of the bore.

20. The roof bolt of claim 12, wherein the wedges include a sloped outer surface and further include teeth adapted to engage the cable.

21. A mine roof bolting system for use with a cable and comprising:

a barrel, the barrel having a first end and a second end, the second end defining a generally rounded surface;

a bore extending through the barrel between the first end and the second end, the bore sized to receive the cable and including a tapered portion;

a pair of wedges sized for placement in the tapered portion of the bore, the wedges shaped to cooperate with the tapered portion of the bore so as to frictionally engage a cable disposed in the tapered portion of the bore;

a recess defined in the first end of the barrel;

a driving nut sized for insertion in the recess, the recess and the driving nut arranged such that rotation of the driving nut is transferred through the recess directly to the barrel, the driving nut adapted for engagement by a driving tool; and a support plate having an aperture sized to receive the cable, the aperture including a surface adapted to receive the spherical surface of the barrel.

22. A method of installing a mine roof bolt comprising the steps of:

providing a barrel having a bore, a first end, and a second end, the second and having a rounded surface, the bore extending through the barrel between the first end and the second end and including a tapered portion, the bore sized to receive the cable;

providing a cable disposed through at least a portion of the bore;

providing a pair of wedges sized for placement in the tapered portion of the bore and positioned to engage both the tapered portion of the bore and the cable to thereby frictionally engage the cable;

providing a recess in the first end of the barrel, the recess including a plurality of faces; and inserting a driving nut into the recess and positioned to engage at least some of the faces to permit rotation of the driving nut to be transmitted to the barrel;

using a driving tool to turn the driving nut.

* * * * *

UNITED STATES PATENT AND TRADEMARK OFFICE

CERTIFICATE OF CORRECTION

PATENT NO. : 6,881,015 B2
APPLICATION NO. : 10/676057
DATED : April 19, 2005
INVENTOR(S) : Alexander I. Wallstein et al.

It is certified that error appears in the above-identified patent and that said Letters Patent is hereby corrected as shown below:

In the Claims:

At Column 5, line 49, “and” should be -- end --.

At Column 6, line 49, “and” should be -- end --.

Signed and Sealed this

Twenty-fifth Day of November, 2008

JON W. DUDAS
*Director of the United States Patent and Trademark Office*